United States Patent [19]

Walter

[11] 4,215,910

[45] Aug. 5, 1980

[54] ELECTRICAL CONNECTOR

[75] Inventor: Donald P. G. Walter, Harrow, England

[73] Assignee: AMP Incorporated, Harrisburg, Pa.

[21] Appl. No.: 970,084

[22] Filed: Dec. 15, 1978

[30] Foreign Application Priority Data

Dec. 22, 1977 [GB] United Kingdom ..... 53563/77

[51] Int. Cl.[2] ..... H01R 3/06

[52] U.S. Cl. ..... 339/143 R; 179/35 C

[58] Field of Search ..... 339/143 R, 136 R, 136 M, 339/177 E, 17 C; 179/35 R, 35 C

[56] References Cited

U.S. PATENT DOCUMENTS

| | | | |
|---|---|---|---|
| 2,965,812 | 12/1960 | Bedford | 339/17 C |
| 3,237,146 | 2/1966 | Barker | 339/143 R X |
| 3,535,676 | 10/1970 | Schultz | 339/143 R |
| 3,539,973 | 11/1970 | Antes et al. | 339/143 R |
| 4,070,084 | 1/1978 | Hutchison | 339/143 R |
| 4,094,564 | 6/1978 | Cacolici | 339/14 L |

*Primary Examiner*—Roy Lake
*Assistant Examiner*—Eugene F. Desmond
*Attorney, Agent, or Firm*—Allan B. Osborne

[57] ABSTRACT

An electrical connector comprises a housing of electrically insulating material carrying a plurality of electrical contacts each having a post portion, the post portions being arranged in three parallel substantially coterminous rows; and an electrically conductive shielding member mounted on the center row of post portions and extending the length of the outer rows of post portions thereby to provide shielding between the outer rows of post portions.

2 Claims, 7 Drawing Figures

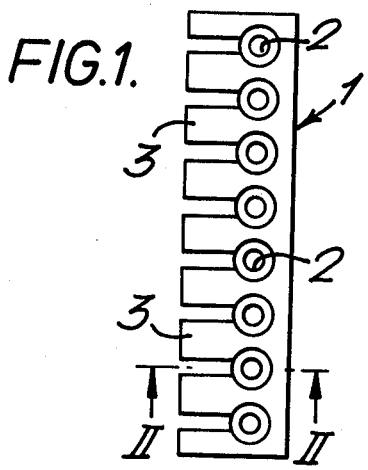
FIG.1.
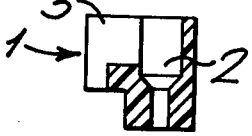
FIG.2.
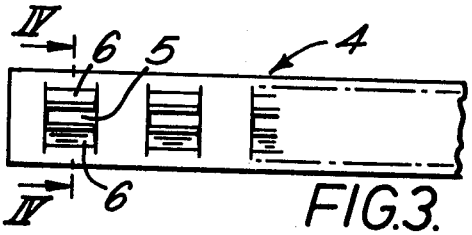
FIG.3.
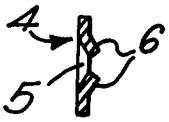
FIG.4.
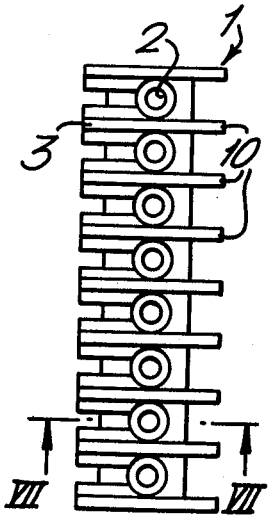
FIG.6.
FIG.5.
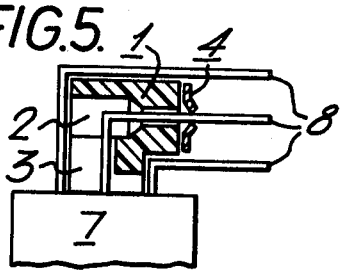
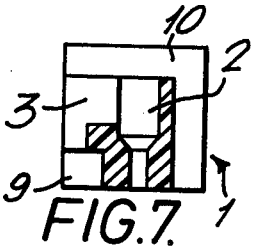
FIG.7.

ELECTRICAL CONNECTOR

This invention relates to an electrical connector.

In electronic equipment there is a need for electrical connectors providing connections in signal paths, and often the signal paths are so closely spaced that difficulties arise from interference between signals being transmitted along adjacent paths.

In order to minimise such difficulties it is known to provide grounding connections in such connectors, such connections serving in effect to filter out undesired interference between signal paths.

However, mere grounding is not always sufficient, and this is particularly so in connectors in which contacts constituting the signal paths through the connector extend through sharp angles, since interference between adjacent signal paths is a particularly large problem in such connectors.

According to this invention an electrical connector comprises a housing of electrically insulating material carrying a plurality of electrical contacts each having a post portion, the post portions being arranged in three parallel substantially coterminous rows; and an electrically conductive shielding member mounted on the centre row of post portions and extending the length of the outer rows of post portions thereby to provide shielding between the outer rows of post portions.

The shielding member can be formed of metal, but has preferably been moulded from an electrically conductive plastics material. Otherwise the shielding member can be formed of a moulded plastics material body carrying a metal plating coating.

In the connector of this invention the shielding member provides effective shielding between the outer rows of post portions which would, in use, constitute signal paths through the connector, while the centre row of post portions would constitute grounding connections.

This is particularly true when the post portions are bent through an angle of say 90°, in which case the shielding member would be shaped to provide shielding at the bends in the post portions.

The shielding member can be retained on the centre row of post portions by means of a spring clip member also mounted on the centre row of post portions, and serving also as a commoning connection between the post portions of the centre row.

An electrical connector according to this invention will now be described by way of example with reference to the drawing, in which:

FIG. 1 is a side view of a shielding member of the connector;

FIG. 2 is a section on the line II—II in FIG. 1;

FIG. 3 is a plan view of a spring clip member of the connector;

FIG. 4 is a section on the line IV—IV in FIG. 3;

FIG. 5 is a diagrammatic view of part of the connector showing the shielding member and spring clip member mounted thereon;

FIG. 6 is a side view of another shielding member for use in the connector in place of the shielding member shown in FIGS. 1 and 2; and FIG. 7 is a section on the line VII—VII in FIG. 6.

Referring to FIGS. 1 and 2, the shielding member 1 is moulded from electrically conductive plastics material, and has a row of spaced parallel through holes 2 separated by spaced parallel projecting walls 3, which give the member 1 a substantially L-shaped cross-section as shown in FIG. 2.

Referring now to FIGS. 3 and 4, the spring clip member 4 comprises a strip of metal having a row of apertures 5 formed therein (only one shown) edge portions 6 on two opposed sides of each aperture 5 being bent out of the plane of the strip as shown in FIG. 4. The spacing between adjacent apertures 5 is the same as the spacing between adjacent holes 2 in the shielding member 1.

Referring now to FIG. 5, the connector comprises a housing 7 moulded from electrically insulating plastics material and carrying a plurality of electrical contacts (not shown in detail) each having a post portion 8 projecting from the housing 7, the post portions being arranged in three parallel substantially coterminous rows extending normally of the drawing.

The post portions 8 are each bent through 90° at a position remote from the housing 7.

As shown, the shielding member 1 is mounted on the centre row of post portions 8 which are received in the holes 2 in the shielding member 1, the walls 3 extending between adjacent post portions 8 of the centre row.

The two outer rows of post portions 8 extend about the two outer L-shaped extremities of the shielding member 1 respectively, while the edge of the shielding member 1 defined by the free ends of the walls 3 engages the housing 7.

The spring clip member 4 is also mounted on the centre row of post portions 8 which are gripped by the edge portions 6 of the member 4. The spring clip member 4 is thus securely fixed to the centre row of post portions 8 and serves to retain the shielding member 1 thereon.

The shielding member 1 thus provides effective shielding between the two outer rows of post portions 8 particularly at the bends therein, while the spring clip member 4 serves as a commoning connection between the post portions 8 of the centre row while also serving to retain the shielding member 1 thereon.

Referring now to FIGS. 6 and 7, the shielding member 1 here shown is basically similar to that shown in FIGS. 1 and 2, but is formed with a plurality of projecting vanes 9 and 10 lying in the planes extending between adjacent holes 2. The vanes 9 are rectangular in cross-section (FIG. 7) and in effect fill in the smaller L-shaped side of the member 1, while the vanes 10 are L-shaped in cross-section (FIG. 7) and extend about the larger L-shaped side of the member 1.

When the shielding member 1 of FIGS. 6 and 7 is mounted on a connector as shown in FIG. 5 for the member 1 of FIGS. 1 and 2, the vanes 9 and 10 will extend between adjacent post portions of the two outer rows of post portions 8 respectively, and thus provide shielding between these adjacent post portions 8.

While the connector described above has only three rows of post portions, it will be appreciated that shielding members as described can be utilised in connectors having more rows of post portions, for example on alternate rows of post portions of connectors having four or more rows of post portions.

I claim:

1. An electrical connector comprising:

a. a housing of electrically insulating material;

b. a plurality of electrical contacts each having a post portion formed in an L-shape, said post portions being arranged in three parallel, substantially coterminous rows in the housing; and c. an electrically conductive shielding member, substantially L-shaped in cross-section, mounted on the center row of post portions and extending the length of the outer rows of post portions and around the bends thereof, said shielding member further having a plurality of spaced parallel walls each extending between a pair of adjacent post portions of the center row with the two outer rows of post portions extending about the outer L-shaped extremities of the shielding member.

2. A connector as claimed in claim 1, wherein the shielding member is formed with a plurality of projecting vanes which project between adjacent post portions of the two outer rows thereof.

* * * * *